US006220930B1

(12) United States Patent
Lin et al.

(10) Patent No.: US 6,220,930 B1
(45) Date of Patent: Apr. 24, 2001

(54) WAFER POLISHING HEAD

(75) Inventors: Juen-Kuen Lin, Kaohsiung; Chien-Hsin Lai, Kaohsiung Hsien; Peng-Yih Peng, Hsinchu; Chia-Jui Chang, Keelung, all of (TW)

(73) Assignee: United Microelectronics Corp., Hsinchu (TW)

( * ) Notice: Subject to any disclaimer, the term of this patent is extended or adjusted under 35 U.S.C. 154(b) by 0 days.

(21) Appl. No.: 09/482,936

(22) Filed: Jan. 14, 2000

Related U.S. Application Data

(63) Continuation-in-part of application No. 09/185,098, filed on Nov. 3, 1998.

(51) Int. Cl.[7] ..... B24B 49/00
(52) U.S. Cl. ..... 451/8; 451/286; 451/287
(58) Field of Search ..... 451/8, 9, 41, 285, 451/286, 287, 288, 26

(56) References Cited

U.S. PATENT DOCUMENTS 5,584,751 * 12/1996 Kobayashi et al. ..... 451/288
5,762,539 * 6/1998 Nakashiba et al. ..... 451/41
5,795,215 * 8/1998 Guthrie et al. ..... 451/286
5,803,799 * 8/1998 Volodarsky et al. ..... 451/288

* cited by examiner

*Primary Examiner*—Timothy V. Eley
*Assistant Examiner*—Dung Van Nguyen
(74) *Attorney, Agent, or Firm*—Oblon, Spivak, McClelland, Maier & Neustadt, P.C.

(57) ABSTRACT

A wafer polishing head for planarizing a wafer. The wafer polishing head comprises a carrier, a retaining ring, a first pressure chamber, a second pressure chamber and an automatic control system. The retaining ring is surrounding the carrier. The first pressure chamber having a first inner pressure is disposed above the retaining ring. The second pressure chamber having a second inner pressure is disposed on the carrier. The automatic control system is respectively coupled to the first pressure chamber and the second pressure chamber.

9 Claims, 2 Drawing Sheets

WAFER POLISHING HEAD

This application is a continuation-in-part of U.S. application Ser. No. 09/185,098, filed on Nov. 3, 1998, now abandoned.

BACKGROUND OF THE INVENTION

1. Field of the Invention

The invention relates to a chemical mechanical polishing (CMP) device, and in particular to a wafer polishing head controlled by gas and liquid pressures.

2. Description of the Related Art

Chemical mechanical polishing (CMP) is a global planarization technique. In chemical mechanical polishing, the rear surface of a semiconductor wafer is fixed by a wafer polishing head. Then, the front surface of the semiconductor wafer is pressed against a polishing pad which is installed on a removable platen. When polishing, a chemical agent conducive to CMP is continuously supplied to the platen. By the chemical reaction between the chemical agent and the front surface of the semiconductor wafer and mechanical polishing, the front surface of the semiconductor wafer can be completely planarized.

The wafer polishing head is used to safely and firmly hold the semiconductor wafer without any damage or contamination on the semiconductor wafer. In an early phase, a semiconductor wafer was adhered on a carrier with a material like wax. After polishing, the wax must be completely removed or the semiconductor wafer is contaminated. Currently, a wafer adhering layer is additionally disposed on the bottom of the carrier. Since the wafer adhering layer is made of a porous material, a semiconductor wafer can be firmly held on the carrier by creating a vacuum environment. However, a high-speed rotation could cause the semiconductor wafer slipping during polishing. Therefore, a retaining ring is additionally installed to surround the semiconductor wafer, thereby preventing the semiconductor wafer from slip. The retaining ring must be rigid and uneasily react with any chemical agent. Typically, Delrin and Tecktron are used to make the retaining ring.

FIG. 1A is a cross-sectional view illustrating a wafer polishing head 10. Referring to FIG. 1A, a carrier 12 is a main body of the wafer polishing head 10. A wafer adhering layer 14, is disposed on the bottom of the carrier 12. The rear surface of a semiconductor wafer 16 is firmly held on the wafer adhering layer 14 by creating a vacuum environment during wafer loading. A retaining ring 18 surrounds the carrier 12 and the semiconductor wafer 16, wherein the bottom of the retaining ring 18 must have a lower position than that of the carrier 12, such that the semiconductor wafer 16 can be prevented from damage during polishing. Furthermore, a first pressure chamber 20 is disposed directly above the retaining ring 18. A diaphragm 22 is disposed on the bottom the first pressure chamber 20 and contact the retaining ring 18. When a gas flows into the first pressure chamber 20, the diaphragm 22 is deformed to press again the retaining ring 18, thereby fixing the retaining ring 18. A second pressure chamber 24 is disposed directly on the carrier 12. When a gas flows into the second pressure chamber 24, a force is created to push the semiconductor wafer 16 via the carrier 12.

FIG. 1B is a flow chart illustrating a pressure control of the wafer polishing head 10 of FIG. 1A. In FIG. 1B, a gas source 26 supplies a gas with a fixed pressure value to the first pressure chamber 20. The second pressure chamber 24 and the carrier 12.

During polishing, the retaining ring 18 always contacts the diaphragm 22, resulting in an abrasion therebetween. Under this condition, it is easy to cause the semiconductor wafer 16 slipping if the bottom of the carrier 12 is lower than that of the retaining ring 18. Therefore, the slipping wafer is easily broken. It is necessary to regularly and manually adjust the retaining ring 18 thereby to maintain the bottom of the retaining ring 18 at a lower position than that of the carrier 12 and to prevent the wafer from being broken.

Additionally, the wafer polishing head uses a gas pressure to provide a vertical force to the semiconductor wafer and the polishing pad, thereby alleviating wabble during polishing. However, the gas pressure depends on the stability of the gas source. As a result, it is easy to cause wabble on the semiconductor wafer and the polishing pad, resulting in a poor polishing uniformity. In order to improve the polishing uniformity, the pressures generated by a gas to press the carrier and the retaining ring are also manually adjusted to different proper pressure values even though the gas comes from the same gas source.

SUMMARY OF THE INVENTION

The invention provides a wafer polishing head for planarizing a wafer. The wafer polishing head comprises a carrier, a retaining ring, a first pressure chamber, a second pressure chamber and an automatic control system. The retaining ring is surrounding the carrier. The first pressure chamber having a first inner pressure is disposed above the retaining ring. The second pressure chamber having a second inner pressure is disposed on the carrier. The automatic control system for adjusting a relative height between the carrier and the retaining ring is respectively coupled to the first pressure chamber and the second pressure chamber.

According to preferred embodiment of the invention, the automatic control pressure device comprises a first converter, a second converter, a controller, a counter, a first regulator and a second regulator. The first and the second converters are respectively coupled to the first and the second pressure chambers but are both coupled to the controller. The controller is respectively coupled to the first and the second regulators. The first and the second regulators are respectively coupled to the first and the second pressure chambers. Additionally, the second pressure chamber is partly filled by a liquid with a relatively low volatility and a relatively low chemical reactivity.

By comparing the feedback pressures of the first and the second pressure chambers, the controller transmits pressure values to the first and the second pressure chambers respectively through the first and the second regulators to adjust the inner pressures of the first and the second pressure chambers. By adjusting the inner pressures of the first and the second pressure chambers, the relative height between the carrier and the retaining ring can be automatically controlled. Hence, the polished wafer does not slip away. In addition, the wafer polishing head can greatly alleviate wabble on the carrier by using a liquid pressure to press the carrier. Accordingly, the wafer polishing head of the invention can greatly improve a polishing uniformity.

BRIEF DESCRIPTION OF THE DRAWINGS

The invention will be more fully understood from the detailed description given hereinbelow and the accompanying drawings, which are given by way of illustration only, and thus do not limit the present invention, and wherein.

DETAILED DESCRIPTION OF THE PREFERRED EMBODIMENTS

Figure 1A:
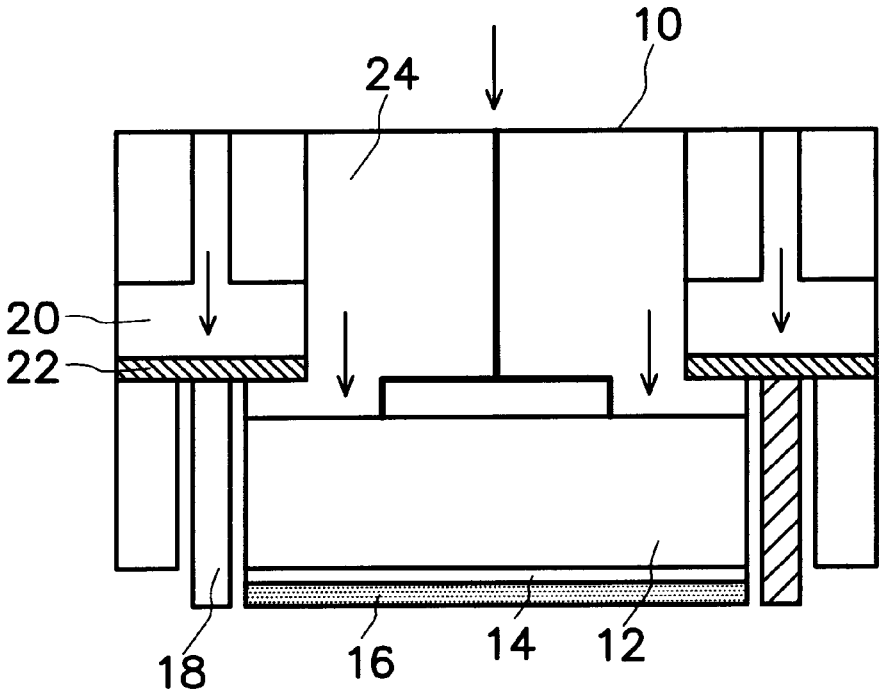
FIG. 1A (PRIOR ART)
FIG. 1A is a cross-sectional view illustrating a wafer polishing head according the prior art.
Figure 1B:
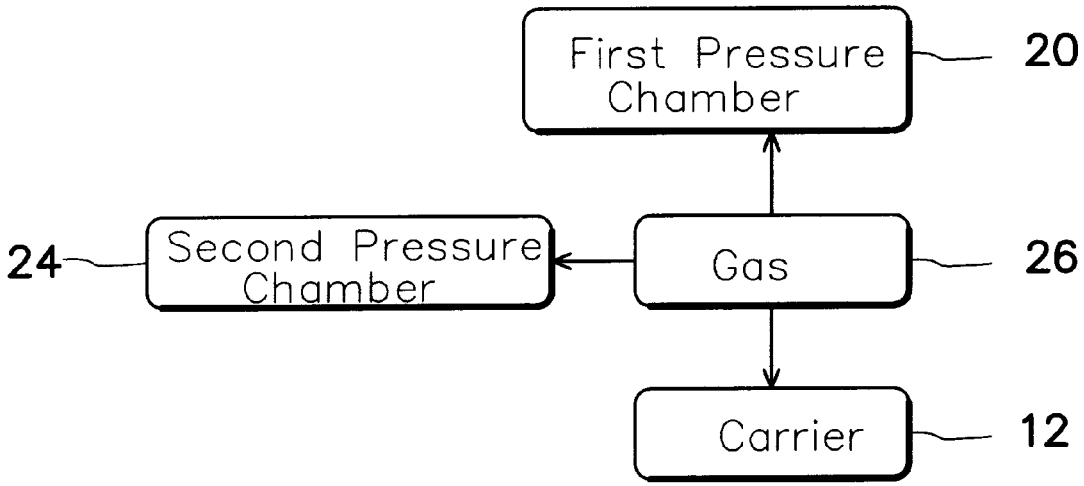
FIG. 1B (PRIOR ART)
FIG. 1B is a flow chart illustrating a pressure control of the wafer polishing head of FIG. 1A.
Figure 2A:
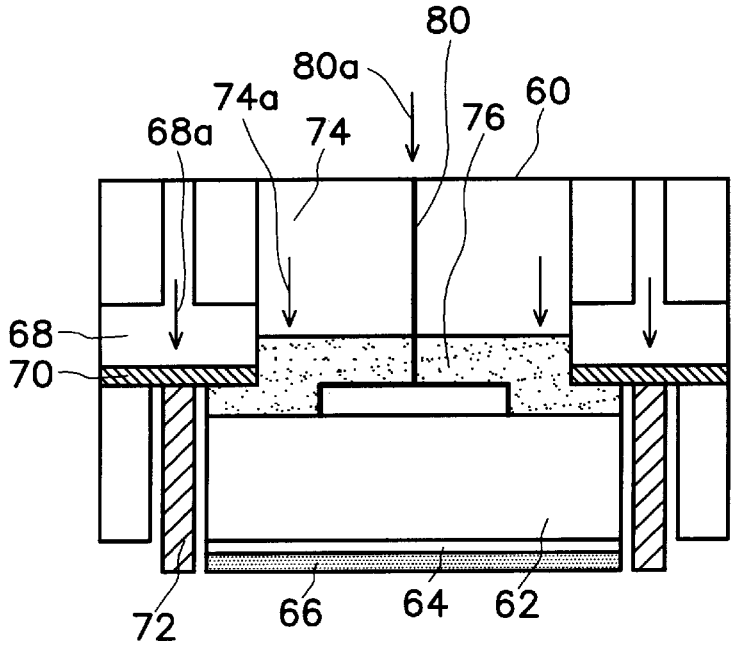
FIG. 2A is a cross-sectional view illustrating one part of a wafer polishing head according to a preferred embodiment of the invention.
Figure 2B:
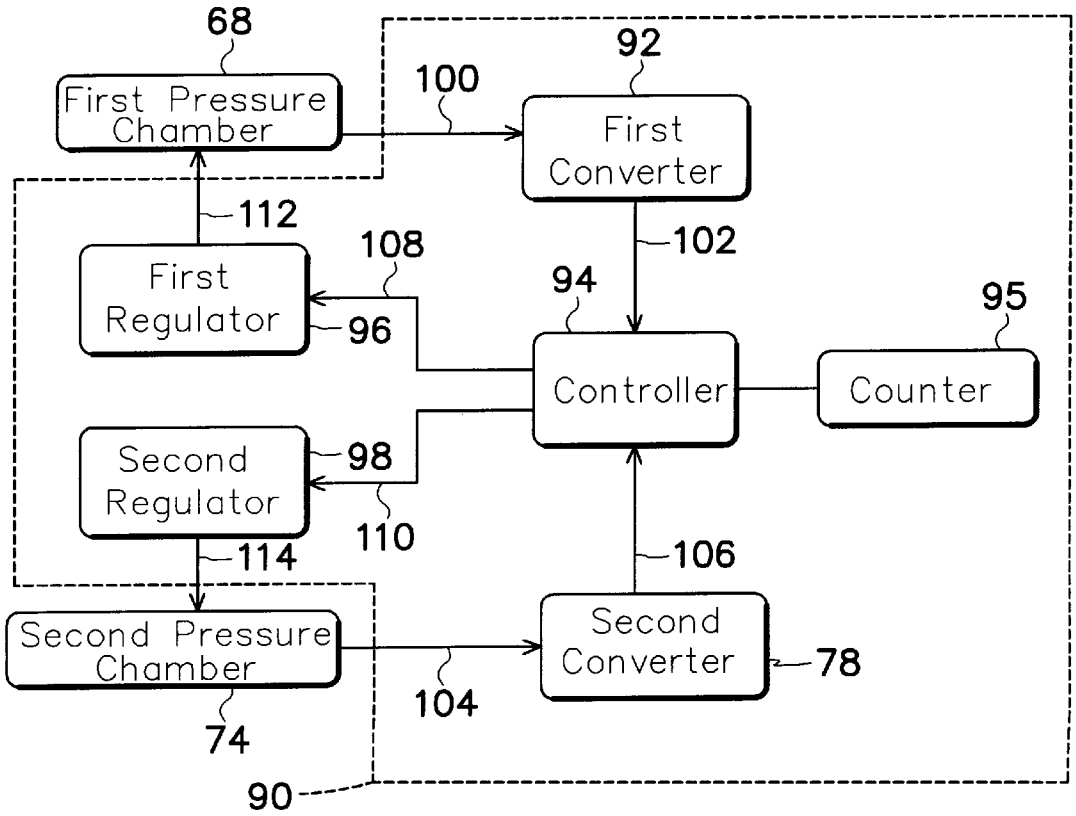
FIG. 2B is a schematic drawing of another part of the wafer polishing head of FIG. 2A.

FIG. 2A is a cross-sectional view illustrating one part of a wafer polishing head according to a preferred embodiment of the invention. FIG. 2B is a schematic drawing of another part of the wafer polishing head of FIG. 2A.

As shown in FIG. 2A, a carrier 62 is disposed at the center region of the wafer polishing head 60. A wafer adhering layer 64, such as a porous plank like felt, is disposed beneath the carrier 62. The rear surface of a semiconductor wafer 66 is firmly held on the wafer adhering layer 64 in a vacuum environment. A retaining ring 72 surrounds the carrier 62, wherein the bottom of the retaining ring 72 is maintained lower than that of the carrier 62. Moreover, a first pressure chamber 68 is disposed directly above the retaining ring 72 with a diaphragm 70 therebetween against the retaining ring 72. A second pressure chamber 74 is disposed directly on the carrier 62 and partly filled by a liquid 76, such as silicon oil, which has low volatility and chemical reactivity. Since the liquid 76 with a relatively low volatility and a relatively low chemical reactivity, the liquid 76 can provide a steady pressure applied on the carrier 62. Therefore, the wabble occurring during CMP process can be efficiently alleviated and the polishing uniformity can be greatly improved.

Additionally, as shown in FIG. 2B, the first pressure chamber 68 and the second pressure chamber 74 are further coupled to an automatic control system 90. The automatic control system 90 comprises a first converter 92, a second converter 78, a controller 94, a counter 95, a first regulator 96 and a second regulator 98. The first pressure chamber 68 and the second pressure chamber 74 are respectively coupled to the first converter 92 and the second converter 78. The first converter 92 and the second converter 78 can be analog/digital (A/D) converters, for example. The first converter 92 and the second converter 78 are both coupled to the controller 94. The controller 94 is respectively coupled to the first regulator 96 and the second regulator 98. The first regulator 96 and the second regulator 98 are respectively coupled to the first pressure chamber 68 and the second pressure chamber 74. Furthermore, the controller 94 is coupled to the counter 95.

While the CMP process is performed, the relative height between the carrier 62 and the retaining ring 72 is controlled by the relationship between the pressures 68*a*, 74*a* and 80*a* respectively applied in the first pressure chamber 68, in the second pressure chamber 74 and on the wafer 66. The pressure 80*a* is directly applied on the wafer 66 through a pressure transmitting pathway 80 and the pressure 80*a* is fixed, wherein the pressure transmitting pathway 80 pass through the carrier 62. The pressures 68*a*, 74*a* and 80*a* can be supplied by fluid such as gas.

Referring to FIG. 2B, at the beginning of the CMP process, preliminary pressures are respectively applied into the first pressure chamber 68, into the second pressure chamber 74 and on the wafer 66. A feedback pressure signal 100 denoting the inner pressure of the first pressure chamber 68 is transmitted from the first pressure chamber 68 to the first converter 92. Simultaneously, a feedback pressure signal 104 denoting the inner pressure of the second pressure chamber 74 is transmitted from the second pressure chamber to the 74 to the second converter 78. The feedback pressure signals 100 and 104 are respectively transformed into feedback digital signals 102 and 106 by the first converter 92 and the second converter 78, respectively. The feedback digital signals 102 and 106 are respectively transmitted from the first converter 92 and the second converter 78 into the controller 94. By comparing the two feedback digital signals 102 and 106 while the CMP process is performed, a digital signal 108 used to control the pressure of the fluid flowing into the first pressure chamber 68 is outputted from the controller 94 to the first regulator 96. Meanwhile, a digital signal 110 used to control the pressure of the fluid flowing into the second pressure chamber 74 is outputted from the controller 94 to the second regulator 98.

The digital signals 108 and 110 are transformed into a pressure value 112 and a pressure value 114 by the regulators 96 and 98, respectively. The pressures of the fluid flowing into the first pressure chamber 68 and the second pressure chamber 74 are respectively adjusted by the pressure values 112 and 114 based on the feedback digital signals 102 and 106. By changing the pressure of the fluid flowing into the first pressure chamber 68, the diaphragm 70 is deformed to apply a proper pressure on the retaining ring 72 and the relative height between the carrier 62 and the retaining ring 72 can be easily controlled. Since the relative height between the retaining ring 72 and the carrier 62 are varied with the pressure of the fluid flowing into the first pressure chamber 68 and the second pressure chamber 74, relative height between the retaining ring 72 and the carrier 62 during the CMP process can be well controlled through the digital signals 108 and 110.

Accordingly, by monitoring the variation of the inner pressures of the first pressure chamber 68 and the second pressure chamber 74 while the CMP process is performed to planarize the surface of the wafer, the dynamic response of the relative height between the carrier 62 and the retaining ring 72 can be easily controlled by changing the pressure of the fluid flowing into the first pressure 68 and the second pressure chamber 74. As a result, the bottom of the retaining ring 72 is frequently maintained lower than that of the carrier 62, thereby preventing the semiconductor wafer 66 from slip. Therefore, the conventional problem of the wafer slipping away during the CMP process. Moreover, it is unnecessary to manually adjust the position of the retaining ring 72, regularly.

Incidentally, the counter 95 is coupled to the controller 94 so that the pressure relationship between the first pressure chamber 68 and the second pressure chamber 74 can be automatically adjusted according to the numbers of the wafer which have been treated by the CMP process.

Altogether, the advantages of the wafer polishing head according to the invention are as follows:

(1) A polishing uniformity is greatly improved since the liquid pressure generated to press the carrier can efficiently alleviate wabble, and make the carrier and the semiconductor wafer parallel to each other.

(2) The relative height between the retaining ring and the carrier is adjusted by the automatic control system, that comprises the first and the second converters, the controller, the counter and the first and the second regulator, without manual adjustments. This ensures that the bottom of the retaining ring is always lower than that of the carrier. Therefore, the semiconductor wafer can be well protected during polishing and the lifetime of the retaining ring is extended.

(3) The controller is coupled to the counter, so that the pressure relationship between the first pressure chamber and the second pressure chamber can be automatically adjusted according to the numbers of the wafer which have been treated by the CMP process.

While the invention has been described by way of example and in terms of the preferred embodiment it is to be understood that the invention is not limited to the disclosed embodiment. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A wafer polishing head for planarizing a wafer, comprising:

a carrier configured to load the wafer;

a wafer adhering layer disposed beneath the carrier;

a retaining ring surrounding the carrier and the wafer adhering layer;

a first pressure chamber having a first inner pressure disposed above the retaining ring;

a second pressure chamber having a second inner pressure disposed on the carrier, wherein a relative height between the retaining ring and the carrier can be adjusted by changing the first and the second inner pressure; and an automatic control system respectively coupled to the first pressure chamber and the second pressure chamber and for adjusting a relative height between the carrier and the retaining ring, wherein the automatic control system receives a first feedback pressure signal and transmitted from the first pressure chamber and a second feedback pressure signal and transmitted from the second pressure chamber while a chemical-mechanical polishing process is performed, and the automatic control system respectively transmits a first pressure value and a second pressure value to the first pressure chamber and the second pressure chamber, the automatic control system comprising:

a controller;

a counter coupled to the controller;

a first converter coupled to the first pressure chamber and the controller, wherein the first converter receives the first feedback pressure signal while the chemical-mechanical polishing process is performed and transforms the first feedback pressure into a first feedback digital signal, and the first feedback digital signal is transmitted into the controller;

a second converter coupled to the second pressure chamber and the controller, wherein the second converter receives the second feedback pressure signal while the chemical-mechanical polishing process is performed and transforms the second feedback pressure into a second feedback digital signal, and the second feedback digital signal is transmitted into the controller;

a first regulator coupled to the controller and the first pressure chamber, wherein the first regulator receives a first digital signal transmitted from the controller and transforms the first digital signal into the first pressure value; and a second regulator coupled to the controller and the second pressure chamber, wherein the second regulator receives a second digital signal transmitted from the controller and transforms the second digital signal into the second pressure value.

2. The wafer polishing head of claim 1, wherein the first and the second converters are analog/digital (A/D) converters.

3. The wafer polishing head of claim 1, wherein the second pressure chamber is partly filled by a liquid with a relatively low volatility and a relatively low chemical reactivity.

4. The wafer polishing head of claim 1, wherein the first feedback pressure signal denotes the first inner pressure.

5. The wafer polishing head of claim 1, wherein the second feedback pressure signal denotes the second inner pressure.

6. A wafer polishing head for planarizing a wafer, comprising:

a carrier configured to load the wafer;

a retaining ring surrounding the carrier;

a first pressure chamber having a first inner pressure disposed above the retaining ring;

a second pressure chamber having a second inner pressure disposed on the carrier; and an automatic control system respectively coupled to the first pressure chamber and the second pressure chamber, the automatic control system comprising:

a controller;

a first converter coupled to the first pressure chamber and the controller;

a second converter coupled to the second pressure chamber and the controller;

a first regulator coupled to the controller and the first pressure chamber; and a second regulator coupled to the controller and the second pressure chamber.

7. The wafer polishing head of claim 6, wherein the first and the second converters are analog/digital (A/D) converters.

8. The wafer polishing head of claim 6, wherein the automatic control system further comprises a counter coupled to the controller.

9. The wafer polishing head of claim 6, wherein the second pressure chamber is partly filled by a liquid possesses a relatively low volatility and a relatively low chemical reactivity.

* * * * *